United States Patent [19]

Uchida et al.

[11] Patent Number: 5,024,392

[45] Date of Patent: Jun. 18, 1991

[54] KINK PREVENTING DEVICE FOR WINDER

[75] Inventors: Hiroshi Uchida, Oumihachiman; Norio Kubota, Kyoto, both of Japan

[73] Assignee: Murata Kikai Kabushiki Kaisha, Kyoto, Japan

[21] Appl. No.: 466,868

[22] Filed: Jan. 18, 1990

[30] Foreign Application Priority Data

Jan. 25, 1989 [JP] Japan ..... 1-6532[U]

[51] Int. Cl.[5] ..... B65H 49/02; B65H 59/02

[52] U.S. Cl. ..... 242/128; 242/35.6 R; 242/147 R

[58] Field of Search ..... 242/35.6 R, 35.6 E, 242/35.5 R, 35.5 A, 147 R, 128, 129.8, 149

[56] References Cited

U.S. PATENT DOCUMENTS

| | | | |
|---|---|---|---|
| 1,048,889 | 12/1912 | Ryden | 242/128 X |
| 1,254,761 | 1/1918 | Bailey | 242/147 R X |
| 1,597,844 | 8/1926 | Thompson et al. | 242/147 R |
| 1,954,071 | 4/1934 | Dickie et al. | 242/147 R X |
| 2,163,711 | 6/1939 | Selvig | 242/128 |
| 2,366,101 | 12/1944 | Grothey | 242/128 X |
| 2,714,812 | 8/1955 | Leath et al. | 242/128 X |
| 2,793,823 | 5/1957 | Lipe, Jr. | 242/147 R |
| 2,797,056 | 6/1957 | Smetana | 242/128 X |
| 2,800,780 | 7/1957 | Chivington | 242/128 X |
| 2,838,922 | 6/1958 | Gift | 242/128 X |
| 2,869,802 | 1/1959 | Williams | 242/147 R X |
| 2,909,913 | 10/1959 | Strub, Jr. | 242/128 X |
| 2,953,318 | 9/1960 | Hasler et al. | 242/128 |
| 2,965,330 | 12/1960 | Hoekstra | 242/128 |
| 3,043,537 | 7/1962 | Chapman et al. | 242/128 |
| 3,070,325 | 12/1962 | Porter | 242/128 |

*Primary Examiner*—Stanley N. Gilreath
*Attorney, Agent, or Firm*—Spensley Horn Jubas & Lubitz

[57] ABSTRACT

A kink preventing device for preventing occurrence of a kink in a yarn drawn out from a yarn supply bobbin of a winder includes a pair of kink bars supported for opening and closing movement with the yarn supply bobbin interposed therebetween and each having a contacting portion which is arcuately opened along an outer peripheral portion of the bobbin, and a kink bar opening and closing means for moving the kink bars to close until the contacting portions thereof are abutted with each other to connect the kink bars in a ring-like configuration to each other.

9 Claims, 5 Drawing Sheets

FULLY WOUND SIGNAL
62
RDI
63
DRUM START SIGNAL
54
55
RD DS
64
YARN JOINING SIGNAL
58
60
SOL
61
59
TIMER
57
OR
56
F/F
52
TIMER
53
CONSTANT CURRENT CIRCUIT
51
SOL
42
+24V

KINK PREVENTING DEVICE FOR WINDER

FIELD OF THE INVENTION

This invention relates to a kink preventing device for a winder, and more particularly to a kink preventing device for a winder which can normally apply, during prevention of a kink, a releasing resistance for prevention of a kink to a yarn being released.

RELATED ART STATEMENT

Generally in a winder which rewinds a yarn from a yarn supply bobbin to form a package, when a yarn break occurs or when a package has been wound up and a yarn is to be newly rewound from a bobbin, an end of a yarn is drawn out from a bobbin.

A yarn knotting or splicing device for joining a yarn on the side of a bobbin which makes a lower yarn and another yarn on the side of a package which makes an upper yarn is provided for a winder. An end of a yarn on the side of a bobbin which makes a lower yarn is sucked into a sucking device such as a suction pipe so that the yarn may be supplied to a yarn joining device.

By the way, as shown in FIG. 8, a yarn b formed by twisting is wound around a bobbin a, and when the yarn b is drawn out from the bobbin a to a yarn joining device so as to be joined, where the yarn has strong twists, it will shrink into loops and so-called kinks occur. In case such a kink occurs, the yarn may be cut intermediately along a yarn feeding route or may be drawn out to the side of a package.

In order to prevent occurrence of such a kink, conventionally a kink preventing device is provided for a winder as shown in FIG. 8. The kink preventing device has a kink bar c such as a wire, and the kink bar c is contacted with a bobbin head portion d to apply a tension to a yarn b being drawn out from a bobbin to keep the yarn b in a taut condition to prevent a kink.

In particular, a tension is applied to the yarn b drawn out from the bobbin a at a point contacting location between the bobbin head portion d and the kink bar c. Accordingly, the tension of the yarn b is cancelled over about 359 degrees and the yarn is in an unrestricted condition except the point contacting location, and a so-called free zone is increased. Consequently, a yarn having strong twists is likely to shrink, and there is a problem that a kink occurs.

Particularly, upon yarn joining, upon starting of rotation of a drum or when a fully wound condition is reached, the tension applied to the yarn b is insufficient, and there is a tendency that a kink may occur.

OBJECT AND SUMMARY OF THE INVENTION

It is an object of the present invention to provide a kink preventing device for a winder for preventing occurrence of a kink of a yarn wherein a contacting location between a bobbin head portion and a kink bar is enlarged so that, even if a yarn having strong twists is drawn out from a bobbin, occurrence of a kink can be prevented.

According to the present invention, a kink preventing device for preventing occurrence of a kink in a yarn drawn out from a yarn supply bobbin of a winder is constituted from a pair of kink bars supported for opening and closing movement with the yarn supply bobbin interposed therebetween and each having a contacting portion which is arcuately opened along an outer peripheral portion of the bobbin, and a kink bar opening and closing means for moving the kink bars to close until the contacting portions thereof are abutted with each other to connect the kink bars in a ring-like configuration to each other. Thus, the contacting portions of the kink bars are enlarged in a ring-like configuration along a circumferential direction of the bobbin so that, during prevention of a kink, the yarn drawn out from the bobbin may be normally held between and restricted by the bobbin head portion and the contacting portions of the kink bars.

DETAILED DESCRIPTION OF THE PREFERRED EMBODIMENT

In the following, an embodiment of the present invention is described in detail with reference to the accompanying drawings.

Figure 7:
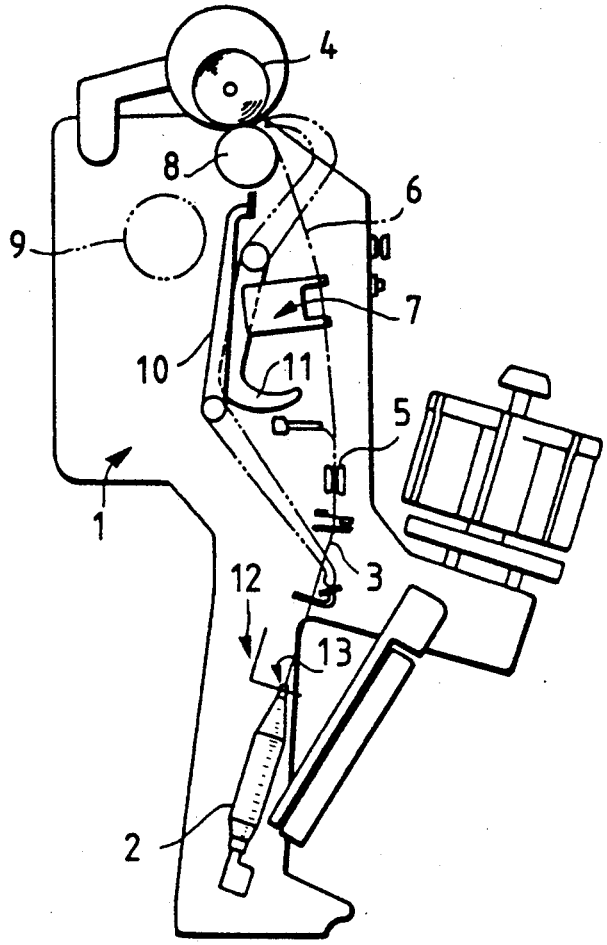
FIG. 7 is a schematic sectional view showing a winder.
Figure 8:
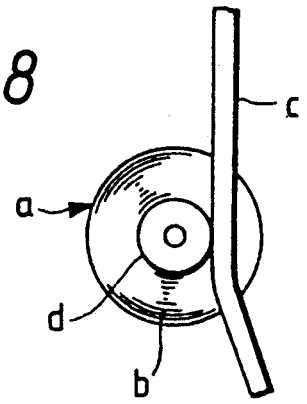
FIG. 8 is a plan view showing a conventional example of a kink preventing device.

FIG. 7 shows a winder according to the present invention.

As shown in FIG. 7, a yarn supply bobbin 2 is provided at a lower location of a winder body 1, and a package 4 which is formed by winding therearound a yarn 3 drawn out from the yarn supply bobbin 2 is provided at an upper location of the winder body 1.

Accordingly, a yarn feeding route for the yarn 3 drawn out from the bobbin 2 is formed between the yarn supply bobbin 2 and the package 4, and a tension device 5 for applying a tension to the yarn (lower yarn) 3 drawn out from the bobbin 2 is provided along the yarn feeding route. A yarn joining device 7 for joining the yarn 3 on the side of the yarn supply bobbin 2 and another yarn 6 on the side of the package 4 to each other is provided at a location above the tension device 5.

A winding drum 8 for contacting with the package 4 is provided at a location above the yarn joining device 7.

Meanwhile, the yarn joining device 7 is controlled in operation by a cam shaft 9, and a suction pipe 10 for sucking the yarn 3 from the bobbin 2 and supplying it to the yarn joining device 7 is provided in a vertical direction of the yarn joining device 7 while a suction arm 11 for sucking the yarn 6 of the package 4 and supplying it to the yarn joining device 7 is provided for up and down pivotal motion at a location above the suction pipe 10.

On the other hand, a kink preventing device 12 for preventing a kink of the yarn 3 drawn out from the bobbin 2 is provided for the winder body 1.

Figure 1:
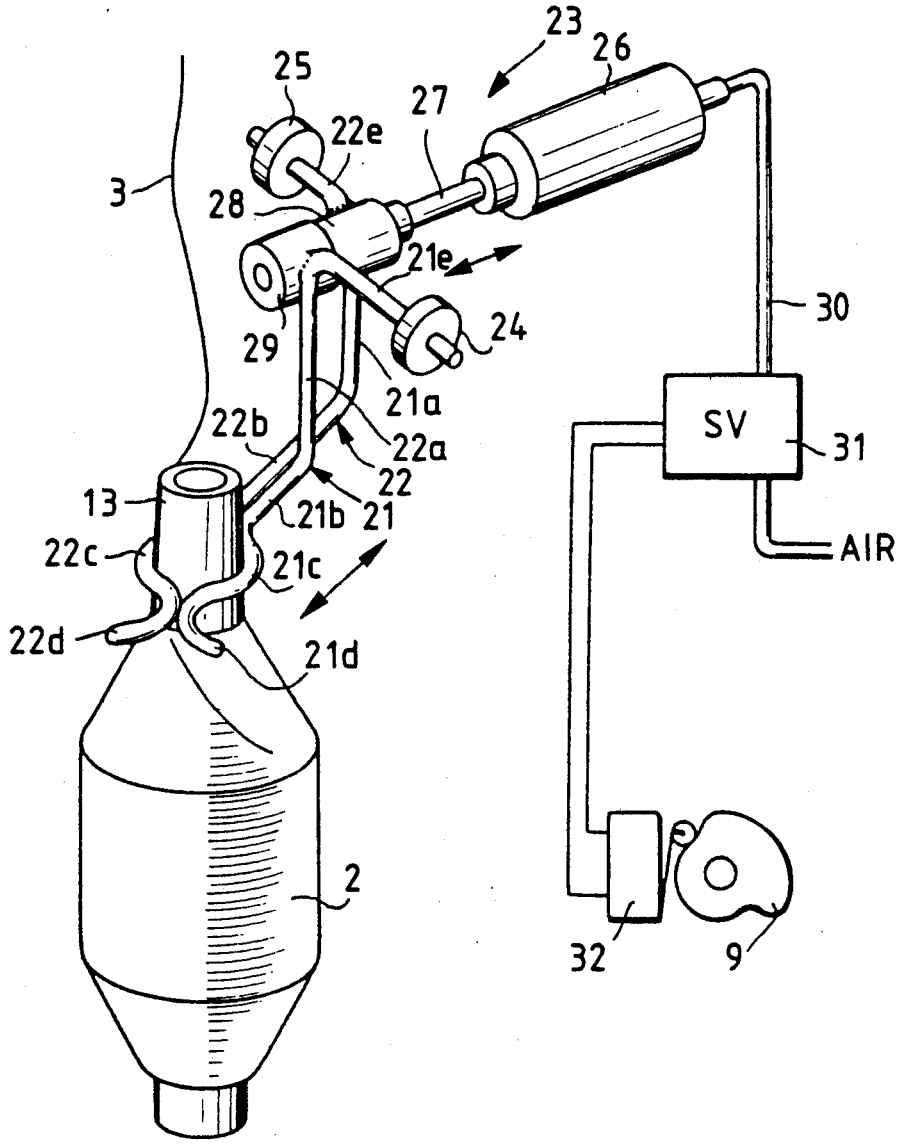
FIG. 1 is a perspective view showing a kink preventing device according to the present invention.

The kink preventing device 12 has a pair of kink bars 21 and 22 which are operated for opening and closing movement with a bobbin head portion 13 of the yarn supply bobbin 2 held therebetween as shown in FIG. 1.

Each of the kink bars 21 and 22 presents an L-shaped configuration having a vertical portion 21*a* or 22*a* extending in an axial direction of the yarn supply bobbin 2 and a horizontal portion 21*b* or 22*b* extending in a horizontal direction from the vertical portion 21*a* or 22*a* in a perpendicular relationship to the bobbin 2, and each of the horizontal portions 21*b* and 22*b* has a contacting portion 21*c* or 22*c* arcuately opened along the bobbin head portion 13 of the yarn supply bobbin 2. Bent out portions 21*d* and 22*d* which are successively bent outwardly such that they may be spaced away from each other are formed at end portions of the contacting portions 21*c* and 22*c*. The bent out portions 21*d* and 22*d* are adapted to be releaseably engaged with the bobbin head portion 13. Accordingly, the horizontal portion 21*b* or 22*b* which is curved in an S-shaped configuration from the arcuate contacting portion 21*c* or 22*c* to the bent out portion 21*d* or 22*d* thereof is formed on each of the kink bars 21 and 22.

Meanwhile, a kink bar opening and closing means 23 for moving the kink bars 21 and 22 to open and close with the yarn supply bobbin 2 held therebetween is connected to the kink bars 21 and 22.

More particularly, weights 24 and 25 for urging the kink bars 21 and 22 in their closing direction are provided for the kink bar opening and closing means 23. The weights 24 and 25 are mounted on the sides of the vertical portions 21*a* and 22*a* of the individual kink bars 21 and 22. In particular, one end portion of each of the vertical portions 21*a* and 22*a* is further bent in a horizontal direction, and the bent portion 21*e* or 22*e* has an end portion formed as a holding portion extending through the weight 24 or 25 for holding the weight 24 or 25 thereon.

Meanwhile, an air cylinder 26 for moving the kink bars 21 and 22 to open and close in horizontal directions is provided for the kink bar opening and closing means 23.

Two cylindrical members 28 and 29 are provided for idle rotation in a contiguous relationship to each other at an end portion of a rod 27 of the air cylinder 26, and the kink bars 21 and 22 are securely mounted in an integrated relationship on the cylindrical members 28 and 29, respectively, by welding or the like. In particular, each of the kink bars 21 and 22 constitutes a lever member which is rocked in up and down directions around a fulcrum portion provided by the cylindrical member 28 or 29, respectively, and each of the kink bars 21 and 22 has the contacting portion 21*c* or 22*c* formed on the side of an application point portion thereof while the weight 24 or 25 for urging the contacting portion 21*c* or 22*c* normally in the closing direction is provided at a force point portion of each of the kink bars 21 and 22.

Meanwhile, a compressed air supply circuit 30 for supplying compressed air to the air cylinder 26 is connected to the air cylinder 26, and a magnet valve 31 for moving the rod 27 back and forth is interposed in the compressed air supply circuit 30. A microswitch 32 for operating the magnet valve 31 is connected to the magnet valve 31, and the microswitch 32 is operated, to be switched on and off by the cam 9. The cam 9 is driven to rotate, for example, upon yarn joining operation.

Figure 2:
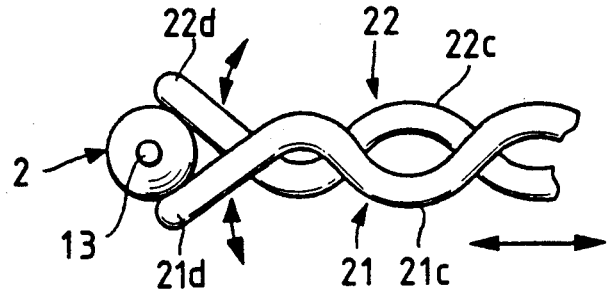
FIG. 2 is a plan view showing a condition wherein kink bars are spaced away from a bobbin.

Accordingly, upon yarn joining, when the rod 27 of the air cylinder 26 is moved backwardly, both of the kink bars 21 and 22 are disengaged from the yarn supply bobbin 2 by the urging forces of the weights 24 and 25 and thus closed in an overlapping relationship in a vertical direction as shown in FIG. 2.

On the contrary, when the rod 27 is moved forwardly, the propelling force of the rod 27 overcomes the urging forces of the weights 24 and 25 so that the bent out portions 21*d* and 22*d* forming the end portions of the kink bars 21 and 22 are engaged with the bobbin head portion 13 and spaced away from each other and then the contacting portions 21*c* and 22*c* are engaged with the yarn supply bobbin head portion 13. In particular, the rod opening and closing means 23 abuts, when the kink bars 21 and 22 are moved to close, the opposite end portions of the contacting portions 21*c* and 22*c* with each other to form a ring which surrounds the bobbin head portion 13.

Since the contacting portions 21*c* and 22*c* are connected to a ring-like configuration from the opposite sides of the bobbin head portion 13 with the bobbin head portion 13 held therebetween in this manner, the yarn 3 drawn out from the yarn supply bobbin 2 is held between and restricted by the bobbin head portion 13 and the contacting portions 21*c* and 22*c* which surround the bobbin head portion 13 so that a tension is applied to the yarn 3. In short, while the yarn 3 is released and drawn out while rotating by 360 degrees, it always undergoes a releasing resistance, and a so-called free zone disappears. Consequently, occurrence of a kink in the yarn 3 can be prevented with certainty.

Figure 3:
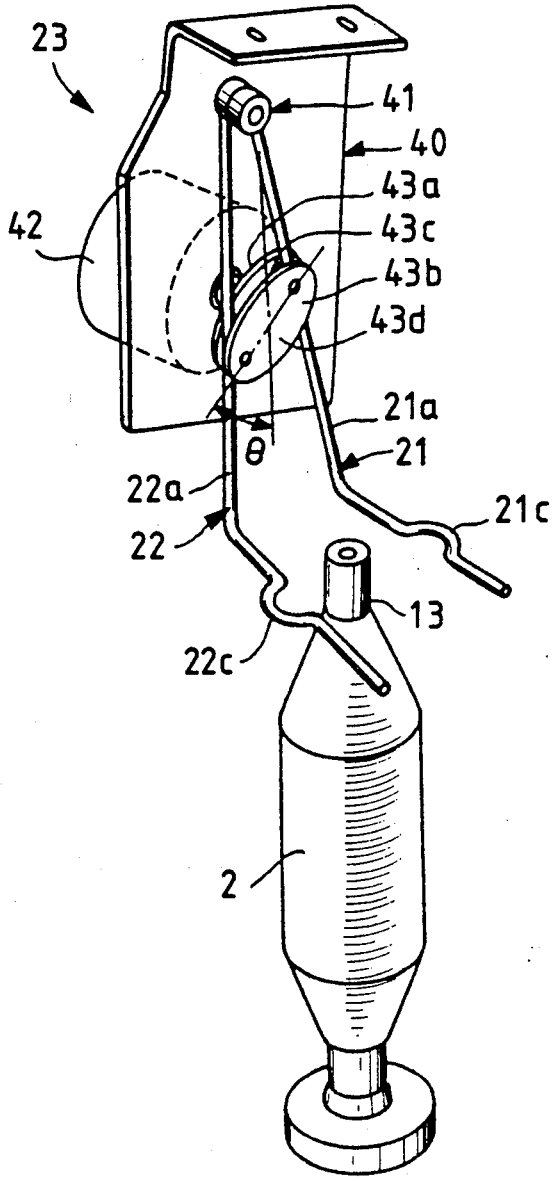
FIG. 3 is a perspective view showing a second embodiment of a kink preventing device.

FIG. 3 shows a second embodiment.

Similarly to the embodiment described above, a pair of kink bars 21 and 22 are provided on the opposite sides of a bobbin head 13 of a yarn supply bobbin 2 with the bobbin head 13 held therebetween. Each of the kink bars 21 and 22 is bent in an L-shaped configuration, and a contacting portion 21*c* or 22*c* which is arcuately opened along the bobbin head portion 13 is formed on a horizontal portion 21*b* or 22*b* of each of the kink bars 21 and 22.

Further, vertical portions 21*a* and 22*a* are formed on the kink bars 21 and 22, and end portions of the vertical portions 21*a* and 22*a* are supported for rocking motion in horizontal directions on a fixing piece (winder body) 40. In particular, a pivotally supporting portion 41 for supporting both of the kink bars 21 and 22 for rocking motion thereon is formed on the fixing piece 40, and the pivotally supporting portion 41 serves as a rocking motion fulcrum portion for the kink bars 21 and 22.

The kink bars 21 and 22 are moved to open and close by a kink bar opening and closing means 23, and the kink bar opening and closing means 23 is constituted from a rotary solenoid 42 mounted on a rear face portion of the fixing piece 40, and a roller 43 mounted on a rotary shaft of the rotary solenoid 42. The roller 43 is positioned between the kink bars 21 and 22.

The roller 43 has a pair of elliptic plate members 43*a* and 43*b*, and the plate members 43*a* and 43*b* are connected on the sides of the opposite ends thereof to each other by way of connecting portions 43*c*. In particular, the kink bars 21 and 22 are held between the elliptic plate members 43*a* and 43*b* while the kink bars 21 and 22 are pressed against and engaged with the connecting members 43*c* by their own weight. Accordingly, when the roller 43 is rotated by a predetermined angle from a position in which the major axes 43*d* of the elliptic plate members 43*a* and 43*b* extend in a vertical direction to another position in which the major axes 43*d* extend in a horizontal direction, it moves the kink bars 21 and 22 away from each other to make an opening operation. On the contrary, when the roller 43 is rotated to the position in which the major axes 43*d* extend in a vertical direction, the individual kink bars 21 and 22 are moved toward each other by their own weight to make a closing operation.

Accordingly, when the rotary solenoid 42 is switched on to rotate the roller 43, the kink bars 21 and 22 make a closing operation, and when the kink bars 21 and 22 make a closing operation, they are abutted with each other along their longitudinal directions so that the opposite end portions of the individual contacting portions 21*c* and 22*c* are abutted with each other to form a ring which surrounds the bobbin head portion 13.

Since the contacting portions 21*c* and 22*c* are connected to each other so as to surround the bobbin head portion 13 in this manner, a tension is normally applied, during prevention of a kink, to the yarn supply bobbin 2 in a similar manner as in the preceding embodiment, and occurrence of a kink can be prevented with certainty.

Figure 4:
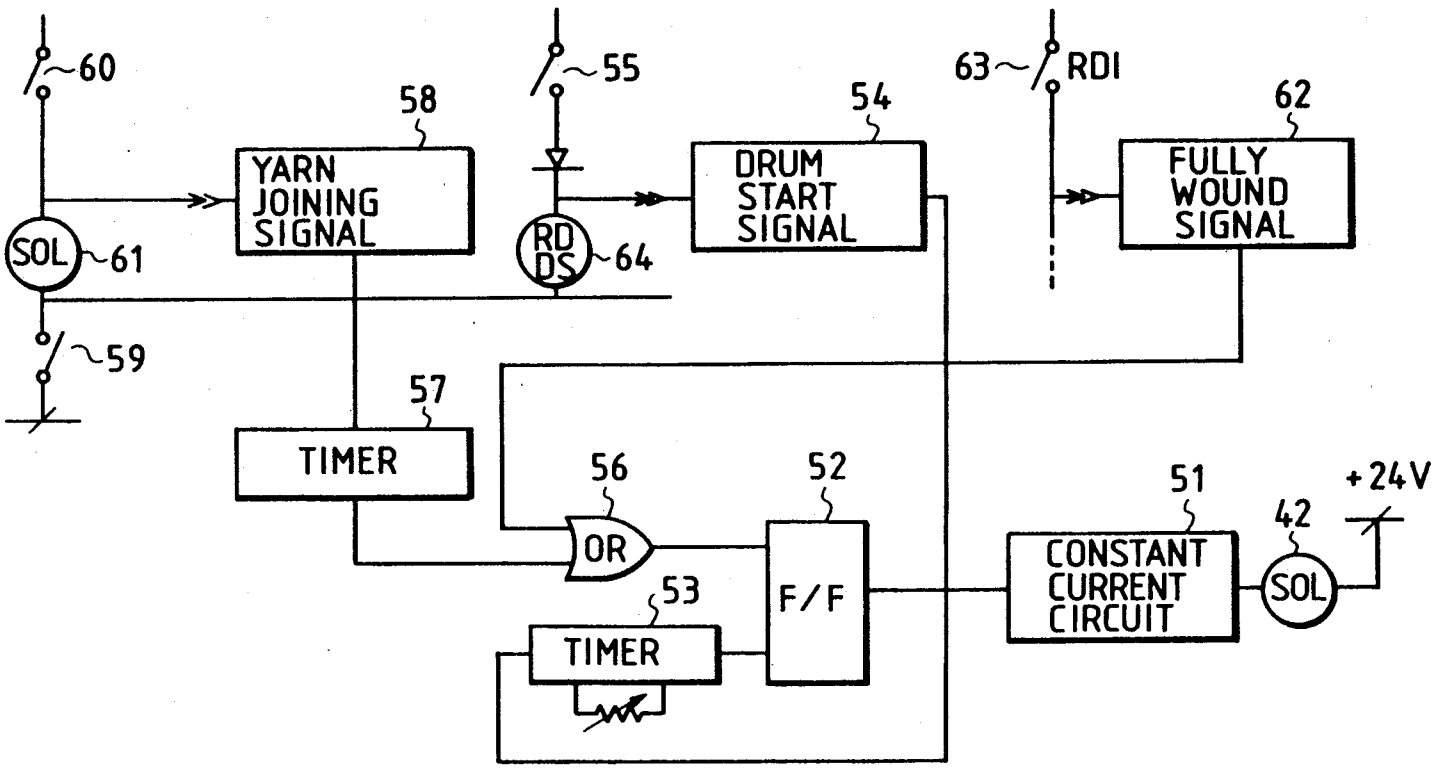
FIG. 4 is a schematic view showing an electric circuit.

Meanwhile, an electric circuit shown in FIG. 4 is adopted for the rotary solenoid 42.

In the present embodiment, an operation timing of the solenoid 42 is determined in response to yarn joining, doffing and drum rotation starting in the winder.

In particular, a constant current circuit 51 and a holding circuit 52 is connected to the rotary solenoid 42. A timer circuit 53 is connected to the holding circuit 52, and a drum starting signal 54 is inputted to the timer circuit 53. Such drum starting signal 54 is developed when a drum switch 55 is turned on.

Meanwhile, an OR circuit 56 is connected to the holding circuit 52, and a timer circuit 57 is connected to the OR circuit 56. A yarn joining signal 58 is inputted to the timer circuit 57. The yarn joining signal 58 is developed when a key button 59 which makes a yarn joining condition is turned on and a relay contact 60 is turned on in response to a yarn break signal from a slub catcher. It is to be noted that the key button 59 is turned off by a solenoid 61 when a yarn joining operation fails three times continuously.

Meanwhile, a fully wound signal 62 is inputted to the OR circuit 56, and the fully wound signal 62 is developed by a turning on operation of a relay contact 63. The relay contact 63 is turned on by a relay coil 64 which is excited by a turning on operation of the drum switch 55.

Accordingly, when a yarn joining signal 58 is developed first, the yarn joining signal 58 passes the holding circuit 52 after, for example, 4.5 seconds by the timer circuit 57 and is outputted to the rotary solenoid 42 for prevention of a kink. Consequently, the kink bars 21 and 22 are moved to close. On the other hand, when rotation of the drum is started, a drum starting signal 54 is inputted to the holding circuit 52 by way of the timer circuit 53. In response to the drum starting signal 54, the rotary solenoid 42 is turned off so that the kink bars 21 and 22 are moved to open. A turning off operation of the rotary solenoid 42 is performed after lapse of a fixed interval of time after starting of rotation of the drum (for example, after 0.5 to 1 second after starting of rotation of the drum) by way of the timer circuit 53.

Meanwhile, when a fully wound signal 62 is inputted to the OR circuit 56, the rotary solenoid 42 is turned on in response to the fully wound signal 62. A drum starting signal 54 is inputted to the holding circuit 52, and the holding circuit 44 is reset shortly after starting of rotation of the drum so that the rotary solenoid 42 is turned off.

Figure 5:
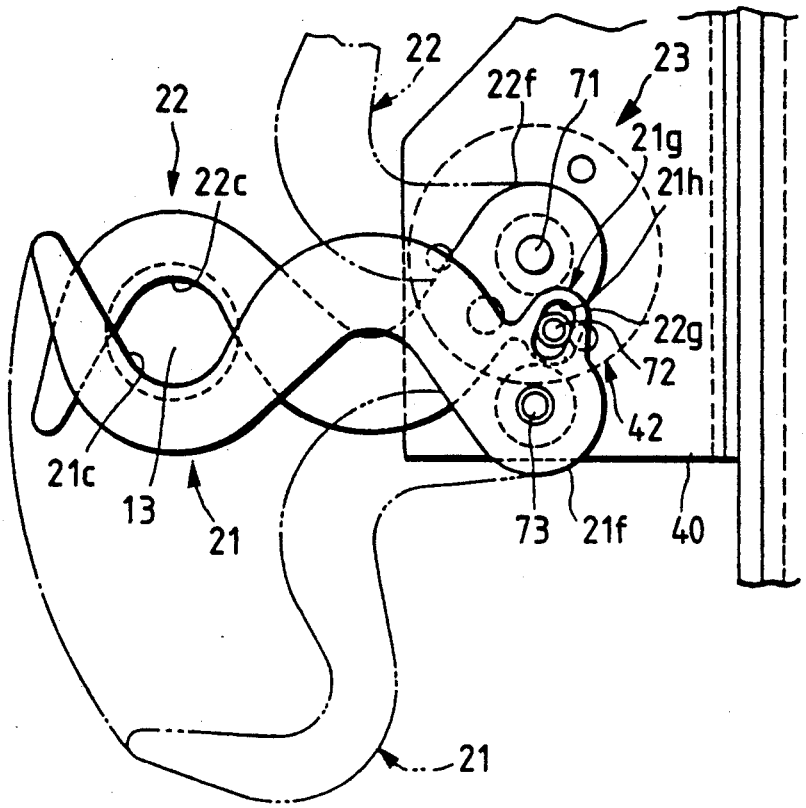
FIG. 5 is a plan view showing a third embodiment of a kink preventing device.
Figure 6:
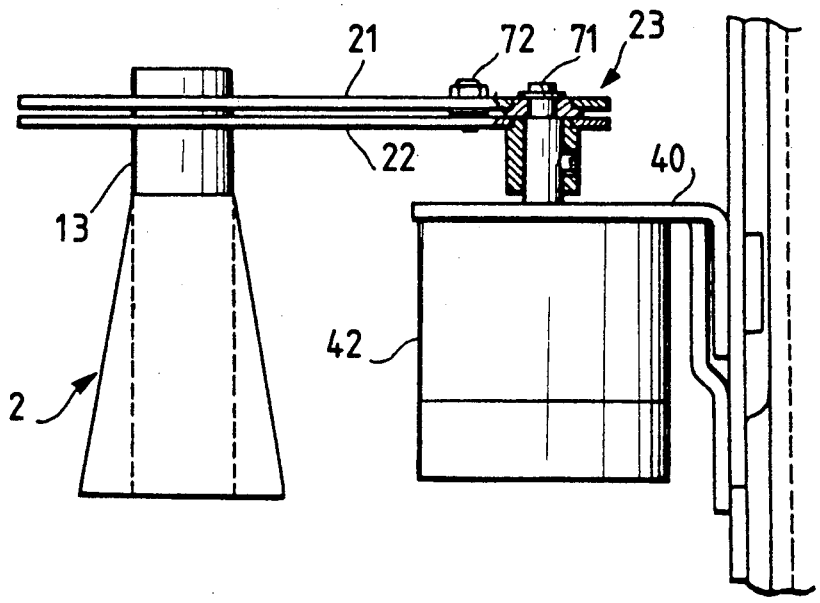
FIG. 6 is a side elevational view of FIG. 5.

Further, FIGS. 5 and 6 show a mechanism which is constructed such that kink bars 21 and 22 are moved to open and close by a simple structure using a rotary solenoid 42 similarly to the embodiments described above.

In particular, the rotary solenoid 42 serving as a kink bar opening and closing means 23 is mounted on a fixing piece (winder body) 40. The pair of driven side kink bar 21 and driving side kink bar 22 are connected to the rotary solenoid 42, and each of the kink bars 21 and 22 are curved in a substantially S-shaped configuration. Contacting portions 21*c* and 22*c* are formed on the sides of end portions of the kink bars 21 and 22 along an outer peripheral portion of a bobbin head portion 13.

Meanwhile, of the kink bars 21 and 22, the driving side kink bar 22 is connected at a base end portion thereof in an integrated relationship to a rotary shaft 71 of the rotary solenoid 42, and the driven side kink bar 21 is connected to the base end portion 22*f* of the driving side kink bar 22 by way of a pin member 72. In particular, projected portions 21*g* and 22*g* which are projected in radially outward directions of the base end portions 21*f* and 22*f* of both of the kink bars 21 and 22 are formed at the base end portions 21*f* and 22*f*, and the projected portions 21*g* and 22*g* are supported for pivotal motion by way of the pin member 72.

Meanwhile, an elongated hole 21*h* for accommodating the pin member 72 therein is formed in the projected portion 21*g* on the driven side.

Meanwhile, the driven side kink bar 21 is supported for pivotal motion by way of another pin member 73 which extends from the fixing piece 40 as shown in FIG. 5. Accordingly, the driven side kink bar 21 constitutes a lever member which is rocked around a fulcrum point provided by the pin member 73 with a force point provided by the projected portion 21*g* of the driven side kink bar 21.

Thus, when the driving side kink bar 22 is moved in the closing direction by a driving source provided by the rotary solenoid 42, the driven side kink bar 21 follows the driving side kink bar 22 and is also moved in the closing direction in a synchronized relationship. When the kink bars 21 and 22 are overlapped in a vertical direction with each other, they overlap the opposite end portions of the contacting portions 21*c* and 22*c* with each other to form a ring which surrounds the bobbin head portion 13. Accordingly, a tension is applied to a yarn 3 drawn out from a yarn supply bobbin 2 similarly to the embodiments described above, and occurrence of a kink can be prevented with certainty.

It is to be noted that the rotary solenoid 42 makes an opening and closing operation for a fixed period of time in response to a yarn joining signal, a drum starting signal or a fully wound signal similarly as in the embodiments described above. Accordingly, when both of the kink bars 21 and 22 make an opening operation, they are moved open in such a manner as to be spaced away from each other as indicated by broken lines in FIG. 5.

In summary, according to the present invention, since contacting portions are formed which are connected to each other in a ring-like configuration along an outer peripheral portion of a yarn supply bobbin, a tension is normally applied to a yarn drawn out from the yarn supply bobbin, and elimination of a kink can be attained with high certainty.

What is claimed is:

1. A kink preventing device for preventing occurrence of a kink in a yarn drawn out from a yarn supply bobbin of a winder, comprising a pair of kink bars supported for opening and closing movement with the yarn supply bobbin interposed therebetween and each having a contacting portion which is arcuately extended along an outer peripheral portion of the bobbin, and having a free end and a kink bar opening and closing means for moving said kink bars to close until the contacting portions thereof are abutted with each other to connect said kink bars in a ring-like configuration to each other.

2. The kink preventing device as claimed in claim 1, wherein each said kink bar comprises a vertical portion extending in an axial direction of a yarn supply bobbin and a horizontal portion where said arcuate contacting portion and said free end, which is bent outwardly such that it is spaced away from the other, are formed.

3. The kink preventing device as claimed in claim 2, wherein said kink bar opening and closing means comprises a weight mounted on a bent end of each said vertical portion, an air cylinder for moving the kind bar pair to open and close in horizontal direction, a pair of cylindrical members provided for idle rotation in a contiguous relationship at an end portion of a rod of the air cylinder, each cylindrical member being associated with a respective kink bar, and an operating means for the air cylinder.

4. The kind preventing device as claimed in claim 3, wherein said operating means for the air cylinder includes a magnet valve for moving the rod of the air cylinder back and forth, a microswitch for operating the magnet valve, and a rotatable cam which operates the microswitch.

5. The kink preventing device as claimed in claim 1, wherein each kink bar is bent in substantially L-shaped configuration comprising a vertical portion extending in an axial direction of a yarn supply bobbin and being supported for rocking motion, and a horizontal portion including said arcuate contacting portion and said free end, and said kink bar opening and closing means is positioned between the vertical portions of the two kink bars.

6. The kink preventing device as claimed in claim 5, wherein said kink bar opening and closing means includes a rotary solenoid and elliptic roller member mounted on a rotary shaft of the rotary solenoid.

7. The kink preventing device as claimed in claim 6, further including means for controlling said rotary solenoid so as to rotate the elliptic roller member.

8. The kink preventing device as claimed in claim 1, wherein said pair of kink bars comprise a driving side kink bar and a driven side kink bar and said kink bar opening and closing means is a rotary solenoid, said driving side kink bar being connected at a base end portion thereof in an integrated relationship to a rotary shaft of the rotary solenoid.

9. A kink preventing device for preventing a kink from occurring in yarn drawn from a yarn supply bobbin, comprising:

a pair of kink bars, each kink bar including an arcuately shaped portion;

means for moving the pair of kink bars such that at least a portion of one kink bar of the pair of kink bars abuts at least a portion of the other kink bar of the pair of kink bars, with the yarn supply bobbin being interposed between the pair of kink bars, wherein the arcuated shaped portion of each kink bar extends along an outer peripheral portion of the bobbin.

* * * * *